US006655040B2

(12) United States Patent
Whipple

(10) Patent No.: US 6,655,040 B2
(45) Date of Patent: Dec. 2, 2003

(54) COMBINATION ULTRAVIOLET CURING AND INFRARED DRYING SYSTEM

(75) Inventor: Rodger E. Whipple, Neenah, WI (US)

(73) Assignee: The Diagnostics Group, Inc., Neenah, WI (US)

( * ) Notice: Subject to any disclaimer, the term of this patent is extended or adjusted under 35 U.S.C. 154(b) by 0 days.

(21) Appl. No.: 10/038,940

(22) Filed: Jan. 4, 2002

(65) Prior Publication Data

US 2003/0126758 A1 Jul. 10, 2003

(51) Int. Cl.[7] ..... F26B 19/00

(52) U.S. Cl. ..... 34/90; 34/275; 34/266; 34/278; 34/245; 34/277; 392/416; 219/757; 250/504 R; 250/495.1

(58) Field of Search ..... 34/267, 90, 278, 34/277, 245, 275, 266, 666; 250/495.1, 504 R, 494.1; 392/416, 417; 219/757

(56) References Cited

U.S. PATENT DOCUMENTS

| | | | | | |
|---|---|---|---|---|---|
| 3,900,959 | A | | 8/1975 | Breschi et al. | 34/155 |
| 3,994,073 | A | | 11/1976 | Lackore | 34/4 |
| 4,000,407 | A | | 12/1976 | Keller et al. | 240/47 |
| 4,143,278 | A | * | 3/1979 | Koch, II | 250/527 |
| 4,434,562 | A | * | 3/1984 | Bubley et al. | 34/4 |
| 4,646,446 | A | | 3/1987 | Bubley | 34/4 |
| 4,882,853 | A | | 11/1989 | Schaft | |
| 5,135,686 | A | * | 8/1992 | Masuhara et al. | 264/22 |
| 5,223,041 | A | * | 6/1993 | Cerney | 134/15 |
| 5,343,629 | A | | 9/1994 | Rae | 34/278 |
| 5,440,821 | A | | 8/1995 | Hamrin | 34/267 |
| 5,537,925 | A | | 7/1996 | Secor et al. | 101/424.1 |
| 5,655,312 | A | * | 8/1997 | Sevcik | 34/275 |
| 5,722,761 | A | | 3/1998 | Knight | 362/96 |
| 5,751,008 | A | | 5/1998 | Jung et al. | 250/504 R |
| 5,861,633 | A | | 1/1999 | Mandellos | 250/504 R |
| 5,973,331 | A | | 10/1999 | Stevens et al. | 250/492.1 |
| 6,026,748 | A | | 2/2000 | Reed et al. | 101/424.1 |
| 6,088,931 | A | | 7/2000 | Aylor et al. | 34/267 |
| 2001/0031229 | A1 | * | 10/2001 | Spjut et al. | 422/186.3 |
| 2002/0033134 | A1 | * | 3/2002 | Fannon | 118/667 |

* cited by examiner

*Primary Examiner*—Ira S. Lazarus
*Assistant Examiner*—Tu Cam Nguyen
(74) *Attorney, Agent, or Firm*—Kinney & Lange, PA

(57) ABSTRACT

A combination ultraviolet curing and infrared dryer system which allows both an ultraviolet curing unit to be used at the same time an infrared dryer is used. The infrared dryer and ultraviolet curing unit are placed in an enclosure having a cooling system which cools both the ultraviolet curing unit and the infrared dryer. The cooling system may comprise an air supply system, or may comprise an air supply system and a water cooling system.

30 Claims, 4 Drawing Sheets

COMBINATION ULTRAVIOLET CURING AND INFRARED DRYING SYSTEM

CROSS-REFERENCE TO RELATED APPLICATION(S)

None.

BACKGROUND OF THE INVENTION

The present invention relates to infrared drying units and more particularly relates to an infrared drying system having an incorporated ultraviolet curing unit.

In the art of printing and coating, liquid substances are applied to sheets and webs of material such as paper, film, and foil. These substances, when manufactured appropriately and solidified, are used to impart various surface properties to the material. Such surface properties include defined patterns of color, through a process of printing, scuff resistance, through a process of clear coating, or stickiness, through a process of applying an adhesive coating. These liquid substances are designed specifically for solidification by one of several methods.

One of the most commonly used methods of solidification is evaporation of the liquid portion of the substance through exposure to a combination of air movement and electrically generated infrared energy. When using air movement and infrared energy, the liquid substance used must be an evaporative coating. The machines used to evaporate such coatings are referred to as infrared dryers (IR dryers). Another method of solidification is polymerization of the liquid substance through exposure to specific wavelengths of electrically generated ultraviolet light. Such liquid substances are called ultraviolet coatings, and the machines used to polymerize such coatings are referred to as ultraviolet curing units (UV curing units).

In general, users of printing and coating machinery have found that evaporative coatings and ultraviolet coatings, and their associated methods of solidification, each have advantages and disadvantages. For example, evaporative coatings are generally less expensive than ultraviolet coatings, but the UV curing units used to solidify ultraviolet coatings generally require less space than the IR dryers used to dry evaporative coatings. These and other considerations dictate whether the user, when printing or coating a particular product, should apply evaporative coatings or ultraviolet coatings.

It is not possible to use IR dryers and UV curing units interchangeably. Because the solidification of ultraviolet coatings requires specific wavelengths of ultraviolet energy, infrared energy cannot be used for solidification of ultraviolet coatings due to infrared energy occupying an entirely different portion of the electromagnetic spectrum. Furthermore, although ultra-violet light sources currently in use generally produce significant amounts of infrared energy in addition to ultraviolet energy, the economics of shorter bulb life and higher power consumption have dictated that a separate infrared source should be used when drying evaporative coatings. Therefore, users of printing and coating equipment who want to have the most flexibility in printing or coating find it necessary to purchase and install both IR drying and UV curing equipment.

Modern drying and curing equipment frequently uses applied power densities in the range of 40 to 100 watts per square inch or higher. At such power densities, efficient and safe operation requires that the equipment be equipped with cooling systems. Electric IR dryers are commonly equipped with moving air cooling systems or water cooling systems to cool the heat emitting elements, electrical connections, and element supports. With either air or water cooling methods, it has been found that the addition of air directed against the substrate and coating enhances the drying by transferring liquid vapor from the substrate and coating to the air. Rather than permit the heated air used for cooling and vapor removal to blow into an area where machine operators are performing their work tasks, an air exhaust system is typically incorporated into the IR drying equipment to remove the heat and vapor laden air and convey it to a controlled destination.

Similar to IR dyers, UV curing equipment is commonly equipped with air or water cooling systems to carry away a portion of the large quantity of heat created by the operation of the ultraviolet energy source used in these systems. When air is used for cooling, the resulting heated air is generally exhausted from the ultraviolet equipment and conveyed to a controlled destination in such a way that it does not contact and heat the substrate unnecessarily. This is additionally beneficial because it prevents the heated air from contacting the UV lamp. As is commonly known by experienced ultraviolet equipment designers, potentially hazardous levels of ozone are formed in quantities proportional to the amount of cooling air which contacts the lamp.

Though it is possible to combine a UV curing unit with an IR dryer, challenges arise which have thus far prevented a successful combination system. In particular, designing a cooling system for use in such a combination system has proven particularly difficult. As a result, IR drying equipment and UV curing equipment are commonly designed and built as separate units, each having its own set of cooling systems. To allow for printing a variety of applications, a facility must have both an IR dryer and a UV curing unit. Requiring both such systems increases costs and occupies more floor space.

Thus, there is a need in the art for an IR drying system capable of incorporating UV curing equipment without compromising the performance of either the IR drying unit or the UV curing unit.

BRIEF SUMMARY OF THE INVENTION

The present invention is a combination UV curing and IR drying system. The combination system comprises both an IR dryer module and a UV curing unit. To allow both the IR dryer module and the UV curing unit to operate at the same time, a cooling system is used to cool the modules. The cooling system comprises an air supply for supplying air to the UV curing unit and IR dryer module. The air passes through the UV curing unit and IR dryer module, cooling the units as necessary. Once the air exits the UV curing unit and IR dryer module, the now warm air is exhausted from the system using an air exhaust system.

DETAILED DESCRIPTION

Figure 1:
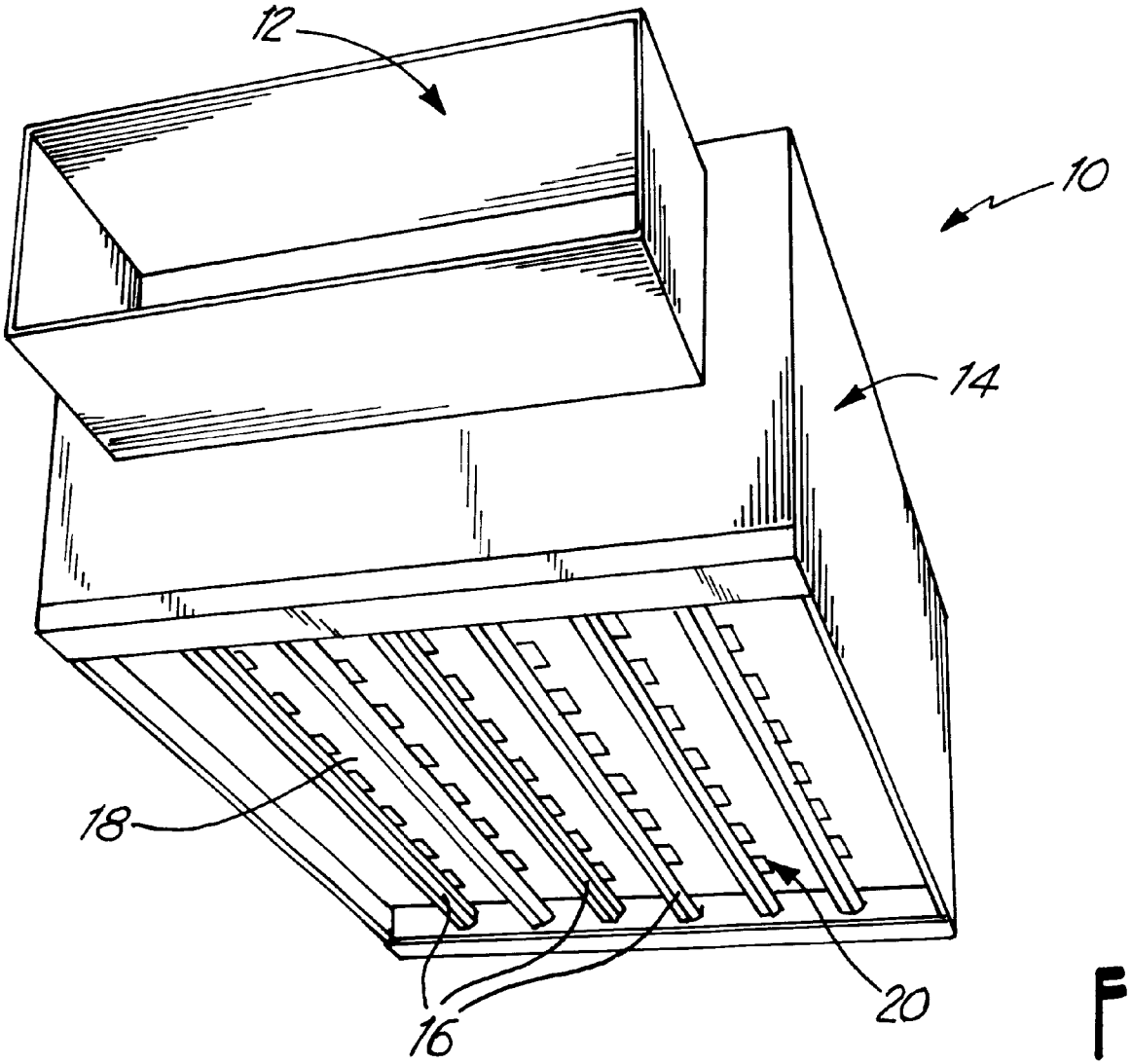
FIG. 1 is a perspective view of a typical infrared heater module suitable for use with the present invention.

FIG. 1 is a perspective view of an infrared dryer 10. The IR dryer 10 comprises a supply air inlet 12 for supplying cooling air to the dryer 10. The dryer 10 also comprises a main housing 14 as well as several infrared bulbs 16 located on the bottom of the dryer 10. A reflector 18 surrounds the infrared bulbs 16 and serves to reflect infrared energy from the bulbs 16 away from the IR dryer and toward the item to be dried, which is typically located a small distance below the dryer 10. Visible at the bulbs 16 are several air outlets 20. The air outlets 20 are located near the bulbs 16 and allow the air from the supply inlet 12 to exit the housing 14 near the bulbs 16. As the air exits past the bulbs 16, it cools the bulbs 16.

Once the cool supply air enters the dryer 10 through the supply air inlet 12, it is distributed inside the housing 14 such that the volume and velocity of the air leaving the IR dryer 10 through each of the multiple air outlets 20 is nearly the same. Due to the internal construction of the IR dryer 10, the presence of the highly effective reflector 18, and the location of the air outlets 20, the cool air supplied via the air inlet 12 also cools the reflector and lamp power connections located inside the IR dryer housing 14.

During this cooling process, energy is transferred from the hot surfaces to the air causing the air temperature to increase. Air temperature increases on the order of 100 degrees Fahrenheit have been measured on infrared heaters, depending on the heater configuration and the power of the radiant energy source. This warmed air can be used to assist in drying the product being dried by directing the warmed air toward the product being dried as the air exits the air outlets 20.

Figure 2:
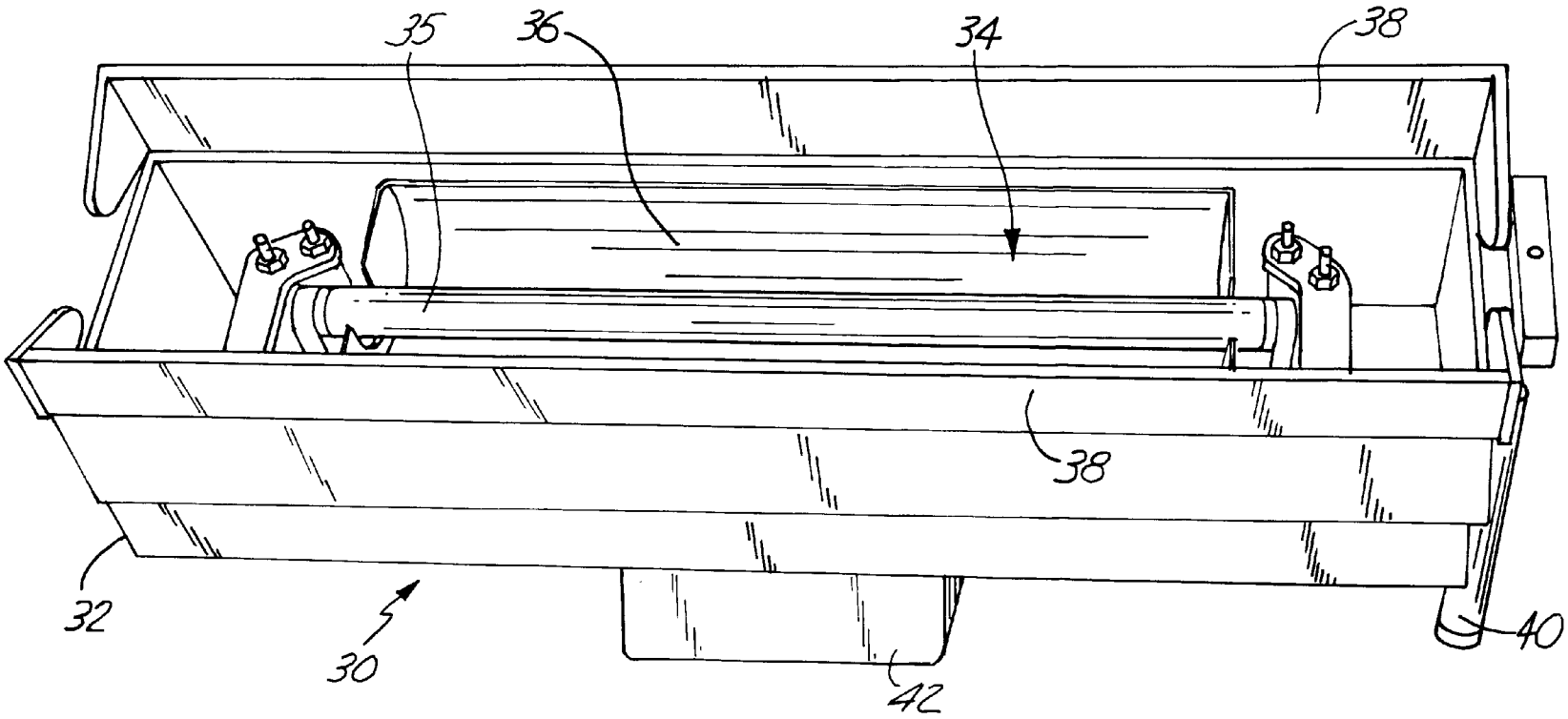
FIG. 2 is a perspective view of a typical ultraviolet curing module suitable for use with the present invention.

FIG. 2 is a perspective view of an ultraviolet curing unit 30 with the curing unit 30 in an inverted positioned so that its features are more visible. The UV curing unit 30 comprises a housing 32 with an inner recess 34 covered with a reflective material 36. The inner recess 34 is configured to receive a UV energy source, such as a bulb 35. The reflective material 36 serves to reflect the UV rays emitted by the UV bulb 35 toward the material being cured.

Also shown on the UV curing unit 30 are shutters 38 which can be actuated by a cylinder 40. Shutters 38 are used in web fed operations in instances when the movement of the web past the curing module 30 must be stopped. When the web is stationary, the shutters 38 can be closed using the cylinder 40 so that the shutters 38 shield the web located directly below the UV curing module 30 from the UV and IR energy emitted by the module 30, preventing the web from potential damage from overexposure to the UV energy and overheating from the IR energy.

Finally, the UV curing unit 30 is also equipped with a supply air inlet 42. Similar to the IR dryer, the UV curing unit must be cooled to ensure proper operation. The supply air inlet 42 is provided on the housing 32 opposite the shutters 38. Cool air is supplied to the housing 32 via the supply air inlet 42. The cool air is forced through the housing 32 and through the inner recess 34 past the UV bulb 35. A variety of methods of supplying cooling air to the may be used with the UV curing unit 30, including for instance an axial flow fan. As the air passes through the housing 32, it cools the components in the housing 32. Similarly, as the air moves past the UV bulb 35, it cools the UV bulb 35 and allows for the most efficient operation of the UV curing unit.

Though there have been attempts at combining into a single system both an IR dryer and a UV curing unit, such as those shown in FIGS. 1 and 2, problems occur with respect to the need to cool the components of each unit. In one design combining an IR dryer and a UV curing unit, the air used to cool the IR dryer and the UV curing unit is exhausted through the UV curing unit. However, removing the air used to cool the IR dryer by passing it through the UV curing unit presents two practical problems. First, the scrubbing action of the supply cooling air impinges on the coated substrate and when drawn past the ultraviolet bulb, can transfer dust and vapor from the substrate or coating to the bulb. When dust or vapor contact the bulb, the bulb's life is shortened and the ultraviolet energy output of the bulb is adversely affected. Second, the IR dryer and UV curing unit cannot be operated simultaneously because cooling air passing through the IR dryer will be heated such that it is no longer able to provide sufficient cooling capacity for the ultraviolet bulb and housing. The heated air likewise shortens the UV bulb life and may cause structural failure of the UV module housing.

Figure 3:
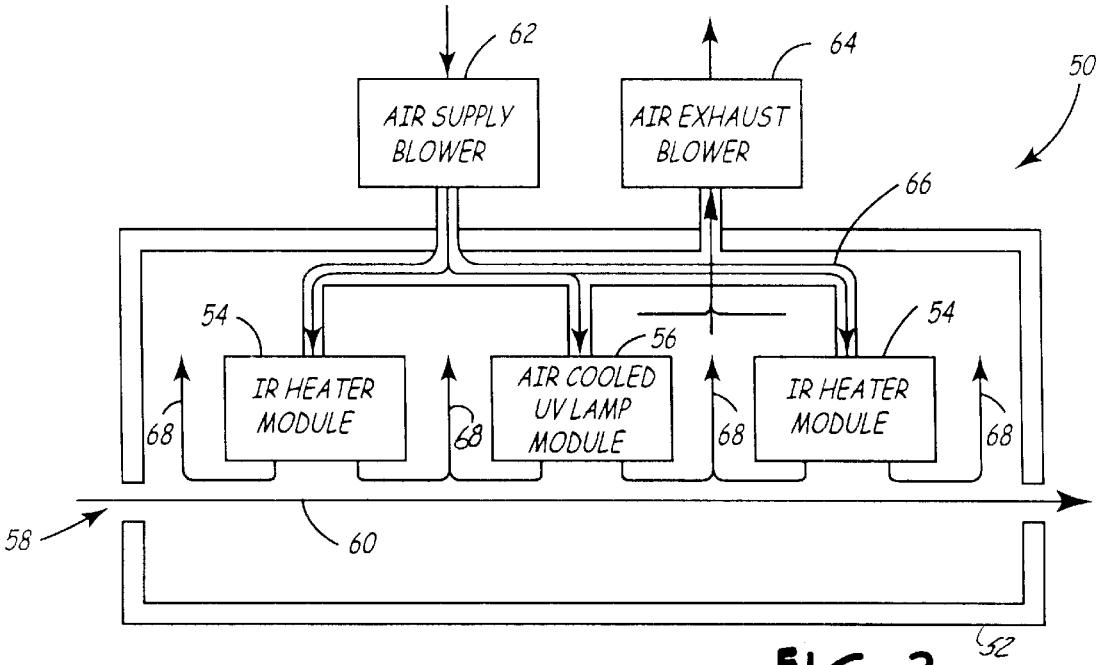
FIG. 3 is a schematic view of an air flow system for use in a combination UV curing and IR drying system.

The present invention solves both of these problems by combining both an IR dryer and a UV curing unit into a single system with a unique cooling system. FIG. 3 is a schematic view of a combination UV curing and IR dryer system 50 according to the present invention. The combination system 50 comprises an enclosure 52 containing two infrared heater modules 54, one air-cooled ultraviolet curing module 56, and a pathway 58 allowing a printed or coated substrate 60 to pass through the enclosure 52. The IR heater and UV curing modules 54, 56 are mounted in close proximity to the coated side of the moving substrate 60 so that the substrate 60 can obtain either the required drying or curing. The substrate 60 may either be in the form of a supported or unsupported web or in the form of supported, discrete sheets.

An air supply 62, such as a blower, is connected either remotely or directly to the enclosure 52. The air supply 62 conveys cooling air into the enclosure 52 and to the IR heater modules 54 and the UV curing module 56. Once supplied to the modules 54, 56, the air may circulate through each module 54, 56 to cool any internal components as necessary. As the air exits the IR dryer modules 54, it cools the IR bulbs. Similarly, as the air exits the UV curing unit 56, it cools the UV bulb. After exiting the modules, 54, 56, the now warmed air flows through the enclosure 52 as indicated generally by arrows 68. The warmed air 68 may further be directed toward the printed material 60 as the substrate 60 passes through the enclosure to speed the drying of the material 60. The warm air in the enclosure 52 is removed using an exhaust system, such as an air exhaust system 64.

As can be seen, clean air is supplied to all modules 54, 56 by the air supply blower 62 along an air supply path 66. Preferably, the air supply path 66 supplies an appropriate amount of air to each module 54, 56 as required for proper operation of the module. By supplying air to the modules 54, 56, the modules are pressurized with clean air so that no contamination from the substrate 60 reaches the bulbs of either module 54, 56 and in particular the bulbs are kept clean and free of life shortening contaminants. The amount of air supplied to each module 54, 56 may vary depending on the desired performance of each module. It may be possible to design a controllable air supply to vary the amount of cooling air supplied to the modules 54, 56.

The ability to control the amount of air supplied to the IR dryer module 54 may be used to increase an amount of air supplied to the dryer module 54 so that in addition to cooling the module 54, the air can be directed toward the substrate 60. Directing the air toward the substrate 60 may be advantageous because the warmed air can assist in removing water vapor in and near the IR coating on the substrate 60 allowing the substrate 60 to dry faster. The air flow to the UV curing module 56 may similarly be controlled to ensure the proper amount of air is supplied to the UV curing module 56, which typically comprises only the amount of air necessary for cooling the UV module 56 and none extra directed toward the substrate 60 to be cured.

It will be apparent to those skilled in the art that there are many options for the air supply source, including an air supply blower attached to the housing or an air supply blower remotely located but capable of supplying the required air through a series of duct work. Further, it may be possible to draw air through the air supply system using only the air exhaust blower 64.

The infrared heater and ultraviolet curing modules 54, 56 are spaced apart from one another by a distance sufficient to permit the cooling air which exits the drying and curing modules 54, 56 to be drawn into the unoccupied portions of the enclosure 52 and thence be conveyed to an air exhaust blower 64. During the cooling process, energy is transferred from the hot surfaces to the air such that the air temperature will increase.

A particular benefit of the combination ultraviolet and infrared drying system is that the IR dryer module 54 and UV curing unit 56 can be used simultaneously. This is particularly advantageous because UV coating liquid is highly viscous, and when applied to a substrate 60, may coat the substrate 60 unevenly and have a slightly bumpy appearance. The application of heat to the UV coating reduces the viscosity of the coating, removing the bumpy appearance of the coating on the substrate and making it easier to evenly apply the UV coating liquid to the substrate. In addition, when ultraviolet coatings with reduced viscosity are cured, they attain a smoother surface and provide increased gloss on the finished product, frequently considered a desirable attribute.

When operating the IR dryer module 54 during UV curing, it is not necessary to operate the IR dryer 54 at full capacity. Rather, the IR dryer module 54 may be operated at a lower energy, sufficient to have the desired effect on the UV coating.

Though only two IR heater modules 54 and a single UV curing module 56 are shown, the invention is not so limited and may contain more of either type of module. For instance, IR dryers having as many as eight IR dryer modules are not uncommon. The configuration and location of the IR dryers and UV curing modules 54, 56 is not important. However, it is desirable to arrange the modules 54, 56 so that when performing a UV cure, that the modules 54, 56 are configured to allow the substrate having the UV coating to be exposed to the IR dryer 54 first, thus reducing the viscosity of the UV coating before the substrate is exposed to the UV curing module 56 for curing.

There are a variety of IR dryers, similar to that shown in FIG. 1, which are suitable for use with the present invention. Any type of IR dryer having an air supply system is suitable. In particular, any IR dryer in which an air supply source draws in ambient air and pressurizes the housing to distribute the cooling air past a light reflector and the radiant energy source is suitable. Similarly, any number of UV curing units similar to that illustrated in FIG. 2 may be suitable for use with the present invention.

Figure 4:
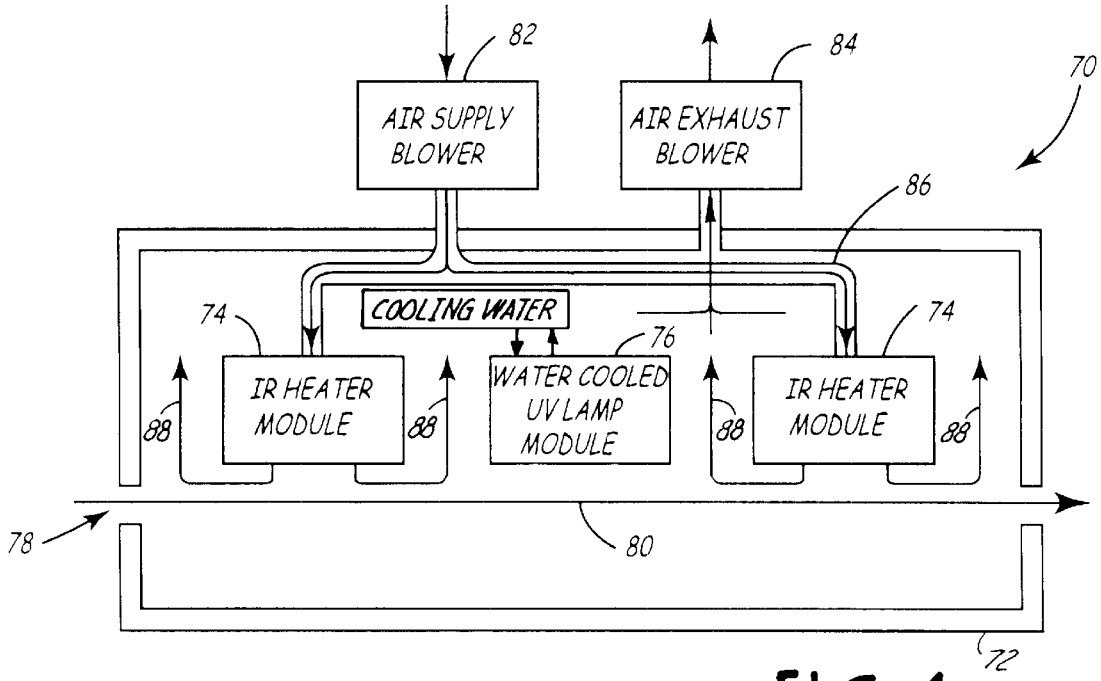
FIG. 4 is a schematic view of an alternate air flow system for use in a combination UV curing and IR drying system.

In addition to air cooled UV curing units, the present invention may include UV curing units which are water cooled. FIG. 4 shows a second embodiment of the present invention in which the UV curing unit is not air cooled, but rather is water cooled.

FIG. 4 is a schematic view of an alternate air flow system for use in a combination UV curing and IR drying system 70. The combination system 70 shown in FIG. 4 comprises an enclosure 72 containing two infrared heater modules 74, one ultraviolet curing module 76, and a pathway 78 allowing a printed or coated substrate 80 to pass through the enclosure 72, either as a supported or unsupported web, or as supported, discrete sheets. An air supply blower 82, either remotely or directly connected to the enclosure 72 conveys cooling air into the enclosure 72 and to the infrared heater modules 74. The infrared heater modules 74 and the ultraviolet curing module 76 are mounted in close proximity to the coated side of the moving substrate 80 so as to allow the substrate 80 to obtain the required drying or curing. In addition, the infrared heater modules 74 and ultraviolet curing module 76 are spaced apart from one another by a distance sufficient to permit the cooling air which exits the modules 74, 76 to be drawn into the unoccupied portions of the enclosure 72 and thence be conveyed to an air exhaust blower 84.

The cooling system of the embodiment illustrated in FIG. 4 differs slightly from that shown in FIG. 3. As can be seen from FIG. 4, the air supply blower 82 conveys cooling air to only the IR dryer modules 74 along an air supply path 86. The cooling air supplied to the IR dryer modules 74 serves to cool the modules 74 as it moves through the modules 74. The path of the now warm air is indicated generally by arrows 88. The warm air is exhausted from the enclosure 72 using the exhaust blower 84. Rather than being air cooled, the UV curing module 76 is configured with a separate cooling system, such as a water cooling system.

Once again, the main benefit of this embodiment of the combination system 70 is that it allows both the IR dryer modules 74 to be used at the same time as the UV curing module 76. This is particularly advantageous in UV cures, where the IR dryer 74 can be operated at a lower energy to warm the UV coating liquid to reduce its viscosity, and thus improve the finished appearance of the substrate, before the substrate is UV cured.

Figure 5:
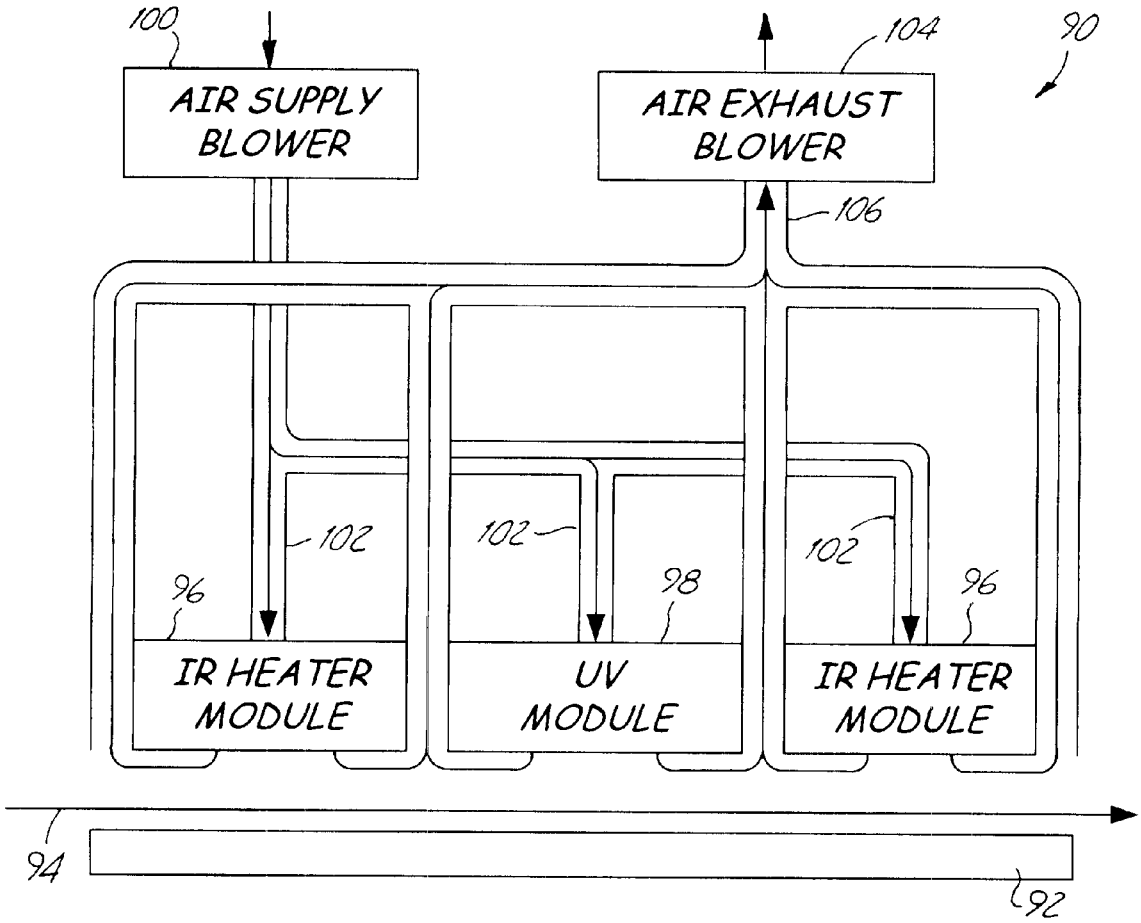
FIG. 5 is a schematic view of an yet another embodiment of a combination UV curing and IR drying system.

FIG. 5 is a schematic view of yet another embodiment of the present invention. Shown in FIG. 5 is a combination ultraviolet curing and infrared drying system 90. The combination system 90 comprises a web enclosure 92 located proximate the web 94. Above the web 94 are two IR heater modules 96 and one UV curing module 98. The modules 96, 98 are cooled by an air supply 100, which provides air to each module 96, 98 through ducts 102. The warmed air is removed from the system by an air exhaust 104. The air exhaust 104 allows warm air to exit the combination system 90 at exhaust ducts 106.

The configuration of the system 90 illustrated in FIG. 5 differs in that the web enclosure 92 does not surround the modules 96, 98. Rather, the system 90 is designed so that while the heated air exiting the modules 96, 98 after cooling is not contained in an enclosure with the modules 96, 98, the heated air none-the-less can be directed to the exhaust 104. For instance, the web enclosure 92 may be in the form of reflectors on the back of the modules 96, 98 or reflectors positioned on the unexposed side of the web 94 which contain the heated air and direct it to the exhaust ducts 106. Alternatively, the web enclosure 92 may be in the form of an enclosure surrounding the web 94 while the modules 96, 98 and air ducts 102 remain unenclosed. In such a system 90, the modules 96, 98 are positioned in close proximity to the web 92 so that the heated air exits the modules 96, 98 and flows toward the web 92. The warm air can be contained in the enclosure 92 surrounding the web 94 so that the air flow from the modules is directed past the web 94 to a common exhaust 104 located on the enclosure 92.

Although the present invention has been described with reference to preferred embodiments, workers skilled in the art will recognize that changes may be made in form and detail without departing from the spirit and scope of the invention. For instance, there are many ways of arranging the drying and curing modules in conjunction with air control baffles and duct work such that the air can be properly distributed to and collected from the modules and the working surfaces.

What is claimed is:

1. A combination ultraviolet curing and infrared drying system, the combination system comprising:

an ultraviolet curing module;

an infrared dryer module; and a cooling system for cooling both the ultraviolet curing unit module and the infrared dryer module which cools each module individually and allows both modules to be used at the same time.

2. The combination system of claim 1 wherein the cooling system comprises:

an air supply for supplying cooling air to the infrared dryer module and the ultraviolet curing module; and an air exhaust to remove the heated air from the combination system.

3. The combination system of claim 2 wherein the air supply further serves to pressurize the modules and prevent contaminants from affecting the performance of the modules.

4. The combination system of claim 2 wherein the air exhaust of the air cooling system comprises:

an infrared dryer exhaust system for exhausting the warm air from the infrared dryer; and an ultraviolet curing exhaust system for exhausting the warm air from the ultraviolet curing unit.

5. The combination system of claim 1 wherein the cooling system comprises:

an air cooling system for cooling the infrared dryer module; and a water cooling system for cooling the ultraviolet curing module.

6. The combination system of claim 2 wherein the infrared dryer and the ultraviolet curing modules are mounted in a single enclosure in close proximity to a path of a coated side of a moving substrate to be dried or cured.

7. The combination system of claim 6 wherein the infrared dryer and ultraviolet curing modules are spaced apart from one another by a distance which allows the cooling air that exits the infrared dryer module and the ultraviolet curing module to be drawn into the unoccupied portion of the enclosure and be conveyed to the air exhaust.

8. The combination system of claim 2 wherein the infrared dryer and ultraviolet curing modules are arranged so that a coated substrate may be exposed to the infrared dryer module before the coated substrate is exposed to the ultraviolet curing module.

9. The combination system of claim 8 wherein the infrared dryer and ultraviolet curing modules are configured to allow the infrared dryer module to reduce a viscosity of an ultraviolet coating on the substrate before the coating is cured by the ultraviolet curing module.

10. The combination system of claim 9 wherein the infrared dryer is operated at a lower energy when used with the ultraviolet curing module than when used by itself to dry an infrared coating.

11. A combination ultraviolet curing and infrared drying system, the combination system comprising:

a plurality of modules comprising at least one ultraviolet curing module and at least one infrared drying module; and a cooling system configured to cool each module individually so that at least one ultraviolet curing module can be used at the same time as at least one infrared drying module.

12. The combination system of claim 11 wherein the cooling system comprises an air cooling system which supplies cooling air to the modules.

13. The combination system of claim 12 wherein the air cooling system supplies each module with air to pressurize the modules and prevent contamination from entering the modules.

14. The combination system of claim 13 wherein the air cooling system comprises:

an air inlet on each infrared dryer module;

an air inlet on each ultraviolet curing module;

an air supply for supplying cool air to the air inlets on the infrared dryer and ultraviolet curing modules;

an air exit on each infrared dryer module which allows the air to exit the infrared dryer module and which cools the infrared dryer module;

an air exit on the ultraviolet curing unit which allows the air to exit the ultraviolet curing unit and which cools the ultraviolet curing module; and an air exhaust for exhausting warmed air from the combination system.

15. The combination system of claim 11 wherein the cooling system comprises an air cooling system which cools the infrared dryer module and a water cooling system which cools the ultraviolet curing module.

16. The combination system of claim 11 wherein the modules are configured to allow an infrared dryer module to reduce viscosity of an ultraviolet coating before the coating is cured by an ultraviolet curing module.

17. The combination system of claim 16 wherein the infrared dryer module is operated at a lower energy when used to reduce a viscosity of an ultraviolet coating before the coating is cured than when used to dry an infrared coating.

18. The combination system of claim 11 and further comprising an enclosure containing the plurality of modules.

19. A combination ultraviolet curing and infrared drying system, the combination system comprising:

an ultraviolet curing module;

an infrared dryer module;

a cooling system for cooling both the ultraviolet curing unit module and the infrared dryer module which allows both modules to be used at the same time;

wherein the infrared dryer and the ultraviolet curing modules are mounted in a single enclosure in close proximity to a path of a coated side of a moving substrate to be dried or cured and are spaced apart from one another by a distance which allows the cooling air that exits the infrared dryer module and the ultraviolet curing module to be drawn into the unoccupied portion of the enclosure and be conveyed to the air exhaust;

wherein the cooling system further comprises:

an air supply for supplying cooling air to the infrared dryer module and the ultraviolet curing module; and an air exhaust to remove the heated air from the combination system.

20. The combination ultraviolet curing an infrared drying system of claim 19 wherein the air supply further serves to pressurize the modules and prevent contaminants from affecting the performance of the modules.

21. The combination system of claim 19 wherein the infrared dryer and ultraviolet curing modules are arranged so that a coated substrate may be exposed to the infrared dryer module before the coated substrate is exposed to the ultraviolet curing module.

22. The combination system of claim 21 wherein the infrared dryer and ultraviolet curing modules are configured to allow the infrared dryer module to reduce a viscosity of an ultraviolet coating on the substrate before the coating is cured by the ultraviolet curing module.

23. The combination system of claim 22 wherein the infrared dryer is operated at a lower energy when used with the ultraviolet curing module than when used by itself to dry an infrared coating.

24. A combination ultraviolet curing and infrared drying system, the combination system comprising:

a plurality of modules comprising at least one ultraviolet curing module and at least one infrared drying module; and a cooling system configured to cool the modules so that at least one ultraviolet curing module can be used at the same time as at least one infrared drying module;

wherein the cooling system comprises an air cooling system which supplies cooling air to the modules and pressurizes the modules to prevent contamination from entering the modules.

25. The combination system of claim 24 wherein the air cooling system comprises:

an air inlet on each infrared dryer module;

an air inlet on each ultraviolet curing module;

an air supply for supplying cool air to the air inlets on the infrared dryer and ultraviolet curing modules;

an air exit on each infrared dryer module which allows the air to exit the infrared dryer module and which cools the infrared dryer module;

an air exit on the ultraviolet curing unit which allows the air to exit the ultraviolet curing unit and which cools the ultraviolet curing module; and an air exhaust for exhausting warmed air from the combination system.

26. A combination ultraviolet curing and infrared drying system, the combination system comprising:

a plurality of modules comprising at least one ultraviolet curing module and at least one infrared drying module;

a cooling system configured to cool the modules so that at least one ultraviolet curing module can be used at the same time as at least one infrared drying module wherein the cooling system comprises an air cooling system which cools the infrared dryer module and a water cooling system which cools the ultraviolet curing module.

27. A combination ultraviolet curing and infrared drying system, the combination system comprising:

a plurality of modules comprising at least one ultraviolet curing module and at least one infrared drying module, wherein the modules are configured to allow an infrared dryer module to reduce viscosity of an ultraviolet coating before the coating is cured by an ultraviolet curing module; and a cooling system configured to cool the modules so that at least one ultraviolet curing module can be used at the same time as at least one infrared drying module.

28. The combination system of claim 27 wherein the infrared dryer module is operated at a lower energy when used to reduce a viscosity of an ultraviolet coating before the coating is cured than when used to dry an infrared coating.

29. A cooling system for cooling a combined ultraviolet curing and infrared drying unit having an infrared drying module and an ultraviolet curing module, the cooling system comprising:

an air supply system for providing cooling air to the infrared drying module and to the ultraviolet curing module and pressurizing the infrared and ultraviolet modules to reduce contamination of the modules; and an exhaust system for removing the heated air from the combined ultraviolet curing and infrared drying unit.

30. A cooling system for cooling a combined ultraviolet curing and infrared drying unit having an infrared drying module and an ultraviolet curing module, the cooling system comprising:

an air supply system for providing cooling air to the infrared drying module;

a water cooling system for cooling the ultraviolet curing unit; and an exhaust system for removing the heated air from the combined ultraviolet curing and infrared drying unit.

* * * * *